US006842990B2

(12) United States Patent
Taylor

(10) Patent No.: US 6,842,990 B2
(45) Date of Patent: Jan. 18, 2005

(54) INCLINOMETER SYSTEM

(75) Inventor: Robert M. Taylor, 3622 W. 8th Avenue, Vancouver, B.C. (CA), V6R 1Z1

(73) Assignee: Robert M. Taylor, Vancouver (CA)

( * ) Notice: Subject to any disclaimer, the term of this patent is extended or adjusted under 35 U.S.C. 154(b) by 0 days.

(21) Appl. No.: 10/464,734

(22) Filed: Jun. 19, 2003

(65) Prior Publication Data

US 2003/0233759 A1 Dec. 25, 2003

(30) Foreign Application Priority Data

Jun. 20, 2002 (CA) ..... 2391165

(51) Int. Cl.[7] ..... E21B 47/022
(52) U.S. Cl. ..... 33/304; 73/152.54
(58) Field of Search ..... 33/302–304, 312, 33/313; 175/40; 73/152.01, 152.02, 152.43, 152.54

(56) References Cited

U.S. PATENT DOCUMENTS

| | | | | | |
|---|---|---|---|---|---|
| 3,587,175 | A | * | 6/1971 | Armistead | 33/303 |
| 4,174,577 | A | | 11/1979 | Lewis | 33/302 |
| 4,399,692 | A | * | 8/1983 | Hulsing et al. | 73/152.54 |
| 4,454,756 | A | * | 6/1984 | Sharp et al. | 73/152.54 |
| 4,461,088 | A | | 7/1984 | Van Steenwyk | 33/304 |
| 4,503,622 | A | | 3/1985 | Swartz et al. | 33/366.14 |
| 4,542,647 | A | * | 9/1985 | Molnar | 73/152.54 |
| 4,556,884 | A | * | 12/1985 | Howells et al. | 73/152.02 |
| 4,606,133 | A | | 8/1986 | Mills | 33/366.14 |
| 4,662,209 | A | * | 5/1987 | Brown | 73/152.57 |
| 4,672,752 | A | * | 6/1987 | Hulsing et al. | 33/302 |
| 4,706,388 | A | * | 11/1987 | Van Steenwyk | 33/304 |
| 4,768,152 | A | * | 8/1988 | Egli et al. | 33/304 |
| 4,823,125 | A | * | 4/1989 | Rorden et al. | 33/304 |
| 4,912,662 | A | | 3/1990 | Butler et al. | 33/377 |
| RE33,708 | E | * | 10/1991 | Roesler | 33/304 |
| 5,502,686 | A | * | 3/1996 | Dory et al. | 73/152.16 |
| 5,537,753 | A | * | 7/1996 | Otte et al. | 33/304 |
| 5,962,819 | A | * | 10/1999 | Paulsson | 181/102 |
| 6,041,509 | A | * | 3/2000 | Shelyago | 33/304 |
| 6,065,219 | A | * | 5/2000 | Murphey et al. | 33/544 |
| 6,308,787 | B1 | * | 10/2001 | Alft | 73/152.42 |
| 6,351,891 | B1 | * | 3/2002 | MacGugan | 33/304 |
| 6,453,239 | B1 | * | 9/2002 | Shirasaka et al. | 33/304 |
| 6,487,782 | B1 | * | 12/2002 | Bond | 33/302 |
| 6,543,280 | B2 | * | 4/2003 | Duhon | 73/152.01 |
| 6,631,563 | B2 | * | 10/2003 | Brosnahan et al. | 33/313 |
| 6,714,138 | B1 | * | 3/2004 | Turner et al. | 340/854.3 |
| 2003/0081501 | A1 | * | 5/2003 | Nightingale et al. | 367/57 |

* cited by examiner

*Primary Examiner*—G. Bradley Bennett
(74) *Attorney, Agent, or Firm*—Shapiro Cohen

(57) ABSTRACT

The invention relates to a device for measuring lateral displacement of a casing in a vertical bore and includes an inclinometer probe, a cable, and a cable reel with electronics mounted in the reel hub. The probe contains two servo-accelerometers, a microprocessor and an electrical circuit. The servo-accelerometers provide analog signals that indicate the inclination angle of the vertical bore hole. The electrical circuit converts the analog signal from each servo-accelerometers to a digital signal which is read by the microprocessor. The microprocessor analyses the data and transmits the digital encoded data over a twisted-pair cable to a digital display unit connected to the cable reel hub. DC power for the probe is provided by the electronics in the reel hub over the same twisted-pair cable.

4 Claims, 3 Drawing Sheets

INCLINOMETER SYSTEM

FIELD OF INVENTION

The invention relates to inclinometer systems and more particularly to an improved signal processing circuit for an inclinometer.

Inclinometers are defined as devices for monitoring deformation normal to the axis of a conduit by means of a sensor or probe passing along the conduit. The probe contains a gravity sensing transducer for measuring inclination relative to the vertical axis. The conduit may be installed in a bore hole, land fill or rock fill and is usually installed in nearly vertical alignment. Inclination readings are made to provide data for initial casing alignments for comparison with subsequent reading to define any change in alignment.

Inclinometer systems generally include a permanently installed guide made of plastic, aluminum alloy, steel, fibreglass, reinforced plastic or the like. This guide casing or conduit is preferably provided with axially extending internal tracking grooves for controlling orientation of the probe.

The inclinometer probes generally have opposed pairs of wheels which are received in the longitudinal internal grooves in the casing for guiding the probe or other slope detecting instruments moved through the casing.

Problems encountered in selection of suitable casing and ensuring proper installation and reliability include the climatic conditions effecting plastic pipe during installation. A suitable plastic casing is described in applicant's Canadian Patent 2,032,830.

A Microprocessor or Micro controller is provided in the probe to digitize the output signal sent over a power/communication cable connecting the probe to data processing means at the ground surfaces.

Digital inclinometers are known including those utilizing as a sensor a bistable type level sensor the output of the sensor is digitized to drive a display. However, these devices have not been adapted for use in a bore hole for precise measurements of inclination of a bore hole casing.

Other inclinometers such as U.S. Pat. No. 4,461,088 for use in use bore hole mapping do not provide digital data transmitted along a cable to a display at the surface.

SUMMARY OF THE INVENTION

The present invention relates to a device for measuring lateral displacement of a casing in a vertical bore hole having an inclinometer probe, a cable, and a cable reel with electronics mounted in the reel hub. The probe contains two servo-accelerometers, a microprocessor and an electrical circuit. The servo-accelerometers provide analog signals that indicate the inclination angle of the vertical bore hole. The electrical circuit converts the analog signal from each servo-accelerometers to a digital signal which is read by the microprocessor. The microprocessor processes the data and transmits the digital encoded data over the twisted-pair cable to a digital display unit connected to the cable reel hub. DC power for the probe is provided by the electronics in the reel hub over the same twisted-pair cable.

The advantage of the present invention is in the combination of the two servo-accelerometers, the micro controller and the electrical circuit within the inclinometer probe. The use of servo-accelerometers allows for very accurate readings fo the inclination angle of the vertical bore hole. Furthermore, placement of the electronics and micro controller in the probe permits precision measurements of the two servo-accelerometers and the power supply to the probe to be transmitted over the same single twisted pair cable.

In a first broad aspect the present invention seeks to provide an inclinometer system for measuring lateral displacement of a tubular casing in a vertical bore hole, the casing having at least a pair of longitudinal grooves comprising a first and a second groove located In opposite internal sides of the casing, the inclinometer system comprising:

a probe having at least two pairs of wheels, each pair of wheels being located proximate an upper and a lower end of the probe;

each wheel within each pair of wheels projecting radially from the probe;

a first wheel in each pair of wheels being received in the first groove of the casing and a second wheel in each pair of wheels being received in the second groove of the casing for guiding along and centering the probe within the casing;

a cable having a first, end and a second end, the first end being operatively coupled to the upper end of the probe;

a cable reel for carrying the cable, lowering the probe into and retracting the probe from the grooved casing;

the cable reel having a hub including a first electrical circuit operatively coupled to the second end of the cable;

the probe including:

(a) at least one servo-accelerometer for providing analog signals corresponding to measured inclination angles of the casing as the wheels of the probe move vertically along the grooves of the casing;

(b) a second electrical circuit operatively coupled to each of the at least one servo-accelerometers for processing and digitizing the analog signals provided by each of the at least one servo-accelerometers into digital signals and for transmitting the digital signals, via the cable, to the first electrical circuit located within the hub of the cable reel;

the first electrical circuit located in the hub of the cable reel being constructed and arranged to receive the digital signals transmitted by the second electrical circuit in the probe; and to transmit the digital signals to a digital display unit operatively coupled to the first electrical circuit;

the digital display unit being constructed and arranged to receive the digital signals from the first electrical circuit in the hub of the cable reel, to decode the digital signals into the digitized analog signals corresponding to measured inclination angles and to display the digitized analog signals.

Preferably, the cable includes a single twisted-pair of conductors having a first end and a second end; and wherein (i) the first electrical circuit located in the hub includes:

(a) a power supply means operatively coupled to the first end of the twisted-pair of conductors for providing dc-power signals to the second electrical circuit located in the probe, and (b) an ac-coupled line interface means operatively coupled to the first end of the twisted-pair of conductors for combining digital signals being transmitted to the second electrical circuit in the probe with the dc-power signals and for separating digital signals being received from the second electrical circuit located in the probe from the dc-power signals; and (ii) the second electrical circuit in the probe includes an ac-coupled line interface means operatively coupled to the second end of the twisted-pair of conductors for combining digital signals being transmitted to the first electrical circuit located in the hub with the dc-power signals and for separating digital signals being received from the first electrical circuit located in the hub from the dc-power signals.

Preferably, the digital display unit is wirelessly coupled to the first electrical circuit located in the hub of the cable reel.

at least one servo-accelerometer;

a microprocessor;

an analog to digital converter; and a cable for conducting digital encoded data to a digital display.

In accordance with a second aspect of the invention, there is provided an inclinometer system for measuring lateral displacement of a tubular casing in a vertical bore hole, the inclinometer system comprising:

a first and a second servo-accelerometer for measuring the inclination angle of the casing;

a signal processing means, the signal processing means being coupled to the first and the second servo-accelerometers;

a first and a second communication means, the first communication means being connected to the first signal processing means, the second communication means being connected to the second signal processing means;

a cable for conducting digital encoded data to a digital display unit;

a first and a second power source means, the first power source means being connected to the first communication means, the first signal processing means, the first and the second servo-accelerometers;

DESCRIPTION OF THE PREFERRED EMBODIMENT

Figure 1:
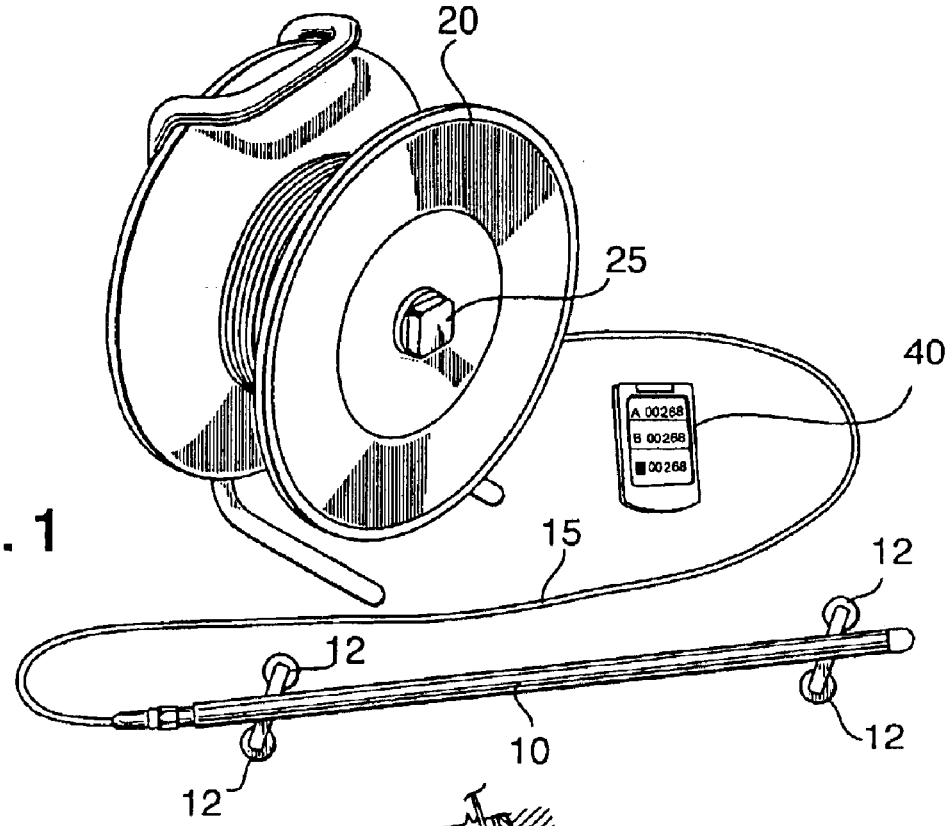
FIG. 1 is a perspective view of the inclinometer system.
Figure 2:
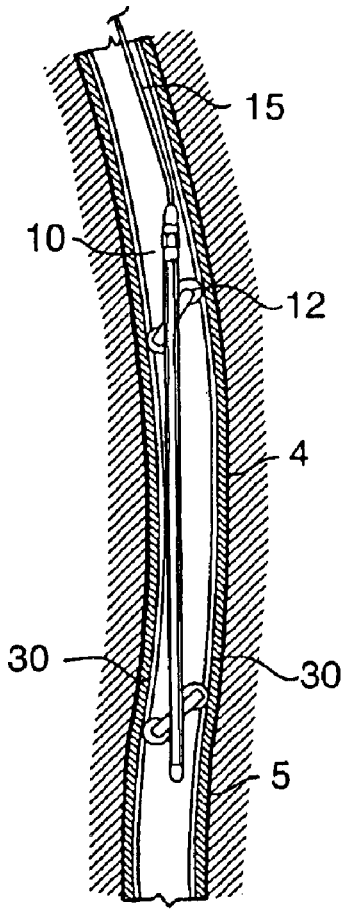
FIG. 2 is a sectional side elevational view illustrating the inclinometer probe in position in a bore hole.

FIGS. 1 and 2 illustrate a device used for measuring lateral displacement of a casing 4 in a vertical bore hole 5 according to the present invention. The device consists of an inclinometer probe 10, a cable 15, and a cable reel 20 which contains electronics mounted in its hub 25. The probe 10 has four wheels 12 which are placed inside grooves 30, of a casing 4, in a vertical borehole. The probe 10 is lowered using the cable reel 20. As the inclinometer probe 10 is lowered into the casing 4, measurements are taken of its inclination angle. The measurements are displayed on a digital display unit 40 which is connected to the cable reel hub 25. The cable 15 supplies power to the inclinometer probe 10 and provides a communication path between the reel hub electronics 25 and the inclinometer probe 10.

Figure 3:
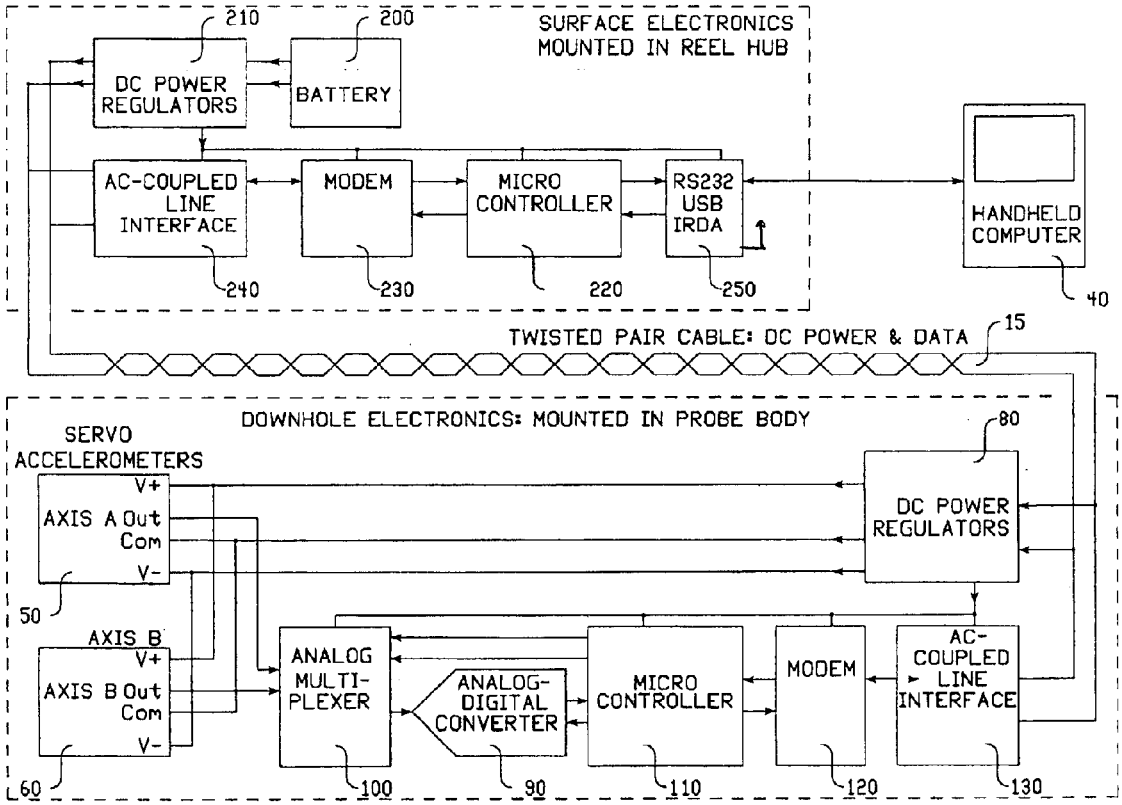
FIG. 3 is a block diagram of the electrical components of the inclinometer.

FIG. 3 is a block diagram of the electronics 55 contained within the inclinometer probe 5 of the present invention. The inclinometer probe 10 contains a first servo-accelerometer 50 and a second servo-accelerometer 60, each of which is connected to an analog multiplexer 100. The servo-accelerometers 50, 60, each have connections to a DC power regulator 80. The DC power regulator 80 supplies to a positive voltage, a negative voltage, and a ground signal to each servo-accelerometer. An analog to digital (A/D) converter 90 is connected to the analog multiplexer 100. The A/D converter 90 is also connected to a micro controller 110. The micro controller 110 has connections to a modem 120 which is connected to an AC-Coupled line interface 130. The DC power regulator 80 supplies DC power to the analog multiplexer 70, the A/D converter 90, the micro controller 100, the modem 120, and the AC Coupled line interface means 130.

According to the present invention, the micro controller 110, which is the central processing unit of the inclinometer probe 10, sends a control signal to the analog multiplexer 100 in order to select a servo-accelerometer 50 or 60 from which to read data. The servo-accelerometer 50 or 60 measures the angle of inclination with respect to an axis of orientation and produces an analog signal representative of the angle of inclination. This analog signal is converted to a digital signal by the A/D converter 90 and is read by the micro controller 100. The micro controller 110 writes the digital data to the modem 120, which modulates the digital data and transmits it, using the AC Coupled line interface means 130, over the cable 15 to the reel hub electronics 25. The AC-Coupled line interface means 130 combines the AC data signals with the DC power signal so that transmission may be done over the single twisted-pair cable 15, thereby reducing the number of wires required in the cable 15.

The modem 120 is also used for two way communication with a digital display unit connected to the reel hub 15. The micro controller 110 can receive data from the receive port 112 of the modem 120. Data is transmitted over the cable 15 from the digital display unit 40. The data is separated from the DC power signal by the AC Coupled line interface, received by the modem 120 and read by the micro controller 110. The micro controller 110 proceeds to perform the measurement or task requested by the digital display unit 40 and transmits a response using the previously described method.

FIG. 3 includes a block diagram of the electronics mounted in the reel hub 25. The reel hub contains a battery 200 that is connected to a DC power regulator 210. The DC power regulator 210 is also connected to the cable 15 in order to supply power to the inclinometer probe 10. The micro controller 220 is connected to the modem 230 and to a communication means 250. The modem 230 is connected to the AC Coupled line interface means 240 which is connected to the cable 15. This allows for two-way communication from the micro controller 220 with the inclinometer probe 10. The communication means 250 is connected to a hand-held computer 40.

According to the present invention, the digital display of a hand held unit 40 displays the inclination angle of the casing 35 of a vertical borehole. The hand held computer 40 acquires data from the down hole inclinometer probe 10 by reading the data from the micro controller 220 using a commercially available communication means 250 such as USB, RS232, or wireless communication. The micro controller 220 communicates with the down hole inclinometer probe 105 using the modem 230. In order to perform a measurement, the micro controller 220 sends a request to the inclinometer probe 10. This request is transmitted from the micro controller 220 to the modem 230, which transmits the digital data signal to the AC Coupled line interface means 240. The AC Coupled line interface means 240 combines the data with the DC power signals from the DC power regulator 210 and feeds the data on to the twisted-pair wire in the cable 15. The requested data is received from the inclinometer probe 10 over the same twisted-wire pair 15. The modulated data stream is received by the AC-Coupled line interface means 240, where it is separated from the DC power signals, demodulated by the modem and transmitted to the micro controller 220. The digital data is converted into an USB or RS232 data format using the communications means 250, and transmitted to the hand-held computer 40 where a measurement is displayed.

Figure 4:
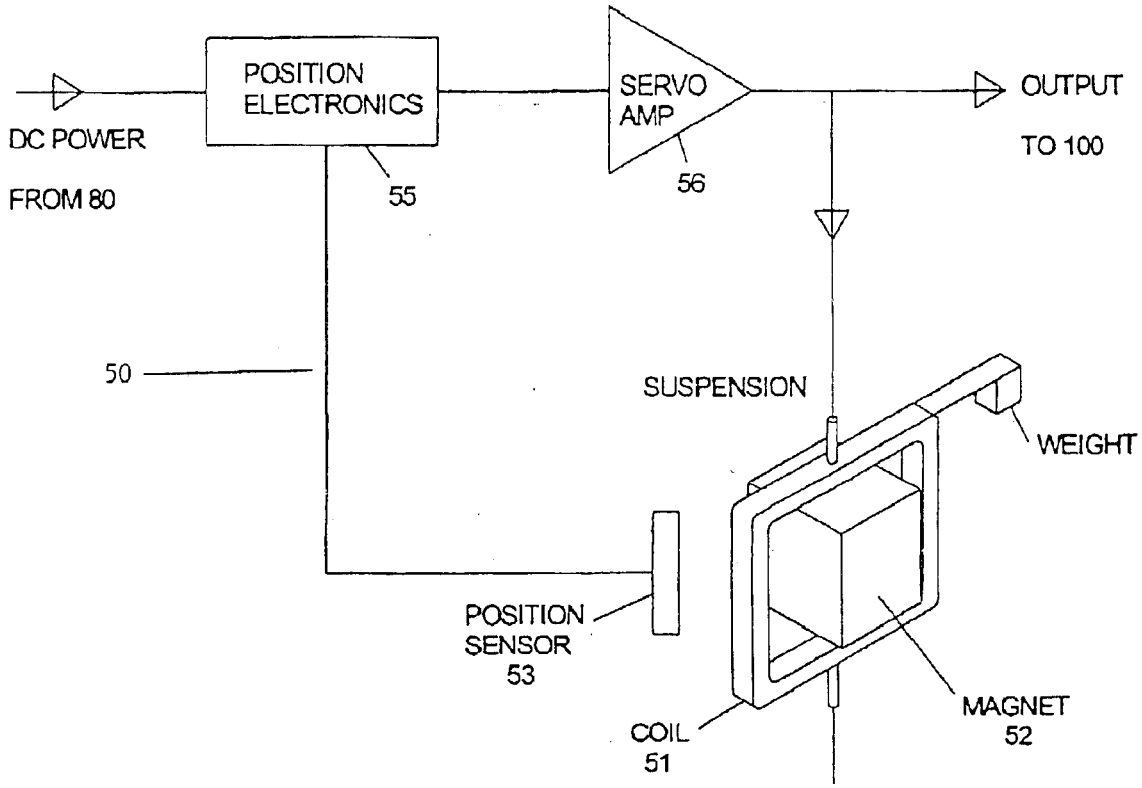
FIG. 4 is a diagrammatic representation of an servo-accelerometer for use in the inclinometer probe.

The servo-accelerometer 50, shown in FIG. 4, consists essentially of a mass attached to a coil 51 which is suspended in a magnetic field generated by a permanent magnet 52. The coil is free to rotate within the magnetic field and when the servo-accelerometer 50 is tilted, a component of the gravitational force acting on the mass tries to induce rotation. The coil 51 thus attempts to move from its null position.

This attempt at movement is detected by a position sensor 53 and a signal is sent to an integral electronics package 55 and a servo amplifier 56 which causes a current to flow in the coil 51. The current produces a force on the coil which is equal to and in the opposite direction to the component of gravitational force. The servo amplifier 56 is connected to the multiplexer 100.

The net effect is that the mass does not move and the magnitude of current generated in the coil is directly proportional to the sine of the tilt angle.

The two servo-accelerometers mounted in orthogonal directions create a biaxial sensor. In all cases, the servo-accelerometers are protected by an outer housing which is filled with oil and de-aired under vacuum.

A digital output was necessary in order that a single cable could connect all sensors to a datalogger for the reasons mentioned previously.

In the known inclinometer control cable reels the slip ring provided to maintain electrical contact as the reel revolves can cause problems. A wireless system has therefore been developed to connect the control cable to the handheld computer display so that a slip ring is not required and therefore there are no electrical continuity problems.

The inclinometer probe 10 preferably consists of a slim torpedo, outside diameter in the range of 25.4 to 28 mm. It is preferably equipped with two servos operating in the range of +30°. System resolution is preferably 24 bit.

A person understanding the above-described invention may now conceive of alternative designs, using the principles described herein. All such designs which fall within the scope of the claims appended hereto are considered to be part of the present invention.

I claim:

1. An inclinometer system for measuring lateral displacement of a tubular casing in a vertical bore hole, the casing having at least a pair of longitudinal grooves comprising a first and a second groove located in opposite internal sides of the casing, the inclinometer system comprising:

a probe having at least two pairs of wheels, each pair of wheels being located proximate an upper arid a lower end of the probe;

each wheel within each pair of wheels projecting radially from the probe;

a first wheel in each pair of wheels being received in the first groove of the casing and a second wheel in each pair of wheels being received in the second groove of the casing for guiding along and centering the probe within the casing;

a cable having a first end and a second end the first end being operatively coupled to the upper end of the probe;

a cable reel for carrying the cable, lowering the probe into and retracting the probe from the grooved casing;

the cable reel having a hub including a first electrical circuit operatively coupled to the second end of the cable;

the probe including:

(a) at least one servo-accelerometer for providing analog signals corresponding to measured inclination angles of the casing as the wheels of the probe move vertically along the grooves of the casing;

(b) a second electrical circuit operatively coupled to each of the at least one servo-accelerometers for processing and digitizing the analog signals provided by each of the at least one servo-accelerometers into digital signals and for transmitting the digital signals, via the cable, to the first electrical circuit located within the hub of the cable reel;

the first electrical circuit located in the hub of the cable reel being constructed and arranged to receive the digital signals transmitted by the second electrical circuit in the probe, and to transmit the digital signals to a digital display unit operatively coupled to the first electrical circuit;

the digital display unit being constructed and arranged to receive the digital signals from the first electrical circuit in the hub of the cable reel, to decode the digital signals into the digitized analog signals corresponding to measured inclination angles and to display the digitized analog signals.

2. The inclinometer system of claim 1, wherein the cable includes a single twisted-pair of conductors having a first end and a second end; and wherein (i) the first electrical circuit located in the hub includes:

(a) a power supply means operatively coupled to the first end of the twisted-pair of conductors for providing dc-power signals to the second electrical circuit located in the probe, and (b) an ac-coupled line interface means operatively coupled to the first end of the twisted-pair of conductors for combining digital signals being transmitted to the second electrical circuit in the probe with the dc-power signals and for separating digital signals being received from the second electrical circuit located in the probe from the dc-power signals; and (ii) the second electrical circuit in the probe includes an ac-coupled line interface means operatively coupled to the second end of the twisted-pair of conductors for combining digital signals being transmitted to the first electrical circuit located in the hub with the dc-power signals and for separating digital signals being received from the first electrical circuit located in the hub from the dc-power signals.

3. The inclinometer system of claim 1, wherein the digital display unit is wirelessly coupled to the first electrical circuit located in the hub of the cable reel.

4. The inclinometer system of claim 2, wherein the digital display unit is wirelessly coupled to the first electrical circuit located in the hub of the cable reel.

* * * * *